US010024086B2

(12) United States Patent
Lesueur

(10) Patent No.: US 10,024,086 B2
(45) Date of Patent: Jul. 17, 2018

(54) VEHICLE DOOR HANDLE COMPRISING TWO LEVERS

(75) Inventor: Guillaume Lesueur, Creteil (FR)

(73) Assignee: U-SHIN ITALIA S.P.A., Pianezza (IT)

( * ) Notice: Subject to any disclaimer, the term of this patent is extended or adjusted under 35 U.S.C. 154(b) by 775 days.

(21) Appl. No.: 13/876,560

(22) PCT Filed: Oct. 13, 2011

(86) PCT No.: PCT/EP2011/067944
§ 371 (c)(1),
(2), (4) Date: May 22, 2013

(87) PCT Pub. No.: WO2012/042065
PCT Pub. Date: Apr. 5, 2012

(65) Prior Publication Data

US 2013/0229022 A1 Sep. 5, 2013

(30) Foreign Application Priority Data

Sep. 28, 2010 (IT) ..... MI2010A1771

(51) Int. Cl.
*E05B 65/12* (2006.01)
*E05B 85/10* (2014.01)
*E05B 85/14* (2014.01)

(52) U.S. Cl.
CPC ..... *E05B 85/10* (2013.01); *E05B 85/14* (2013.01); *Y10T 292/57* (2015.04)

(58) Field of Classification Search
CPC ..... E05B 85/10; E05B 85/14; Y10T 292/57
USPC ..... 292/245, 336.3
See application file for complete search history.

(56) References Cited

U.S. PATENT DOCUMENTS 5,039,145 A * 8/1991 Frye ..... E05B 85/12 292/143
5,702,136 A * 12/1997 Funk et al. ..... 292/336.3
6,158,788 A * 12/2000 Ikeda et al. ..... 292/216
6,530,251 B1 * 3/2003 Dimig ..... 70/237
2011/0068586 A1 * 3/2011 Kutschat et al. ..... 292/29

FOREIGN PATENT DOCUMENTS

DE 195 21 082 C1 8/1996
EP 1 475 494 A2 11/2004
GB 935 660 A 9/1963
WO 2010/037622 A1 4/2010

OTHER PUBLICATIONS

International Search Report issued in PCT/EP2011/067944 dated Dec. 19, 2011 (4 pages).

* cited by examiner

*Primary Examiner* — Matthieu F Setliff
*Assistant Examiner* — Thomas L Neubauer
(74) *Attorney, Agent, or Firm* — Osha Liang LLP

(57) ABSTRACT

The vehicle door handle comprises first and second levers (8, 10) mounted such that they can rotate on a common support (4), these levers being not coaxial and arranged in such a way that the first lever (8) operates the second lever (10) which operates a mechanical link that operates the lock (26).

6 Claims, 1 Drawing Sheet

VEHICLE DOOR HANDLE COMPRISING TWO LEVERS

BACKGROUND

The invention concerns vehicle door handles.

Such a handle includes a manual operating member accessible from outside the vehicle. This member is connected to a mechanism such that maneuvering the member generates traction on a cable inside the door that actuates a downstream mechanism for unlocking the door for it to be opened. Relevant here is the part of the handle situated upstream of the cable.

When a handle is developed, an attempt is made to impart the greatest possible travel to the cable to facilitate the operation of the opening mechanism. However, there is simultaneously the aim to reduce as much as possible the amplitude of the movement of the manual operating member. These two aims are a priori incompatible.

What is more, diverse constraints weigh on the design of the handle. Thus it happens that the movement of the cable must take place in the vertical direction whereas the orientation of the handle is horizontal. There is also the aim to reduce the overall size of the handle.

This being so, handles are known provided with a lever actuated by the operating member that in turn actuates the cable. However, this type of handle makes it particularly difficult to reconcile a long travel of the cable and a small amplitude of the movement of the manual operating member without an exaggerated increase in the load associated with the latter member.

Another solution has been proposed in the document WO 2010/037622 in which the operating member actuates not one but two levers respectively connected to the cable and to its sheath. When one lever pulls on the cable, the other pushes on the sheath, which increases the amplitude of the movement of the cable relative to the sheath. However, the movement of the sheath during the movement of the handle generates noise because of its sliding against the door panel.

SUMMARY OF DISCLOSURE

An object of the invention is to provide a quieter handle that allows both a large amplitude of the movement of the cable and a small amplitude of the maneuvering member.

To this end, the invention provides a vehicle door handle that includes first and second levers mounted so that they can rotate on a common support, these levers not being coaxial and being arranged in such a way that the first lever operates the second lever which operates a mechanical link that operates the lock.

Thus the two levers turn about different axes and the action of the first lever on the second produces a rotation of the latter different from that of the first lever. This yields new possibilities for designing the handle mechanism, which possibilities can be exploited according to whether the aim is to emphasize increasing the amplitude of the movement of the cable, reducing the amplitude of the movement of the operating member or both. What is more, the handle in accordance with the invention does not necessitate the sheath of the cable to be rendered mobile. This therefore eliminates the problem of noise that occurs in the handle referred to above. The elements cited enable effective operation of the handle mechanism downstream of the cable. They may have small dimensions in order to provide a volume sufficient for the other components of the door, namely the window, structural reinforcing elements, etc. The handle can therefore be given smaller dimensions without impacting on the priorities referred to above.

The handle is advantageously such that the first lever is in contact with the second lever.

This reduces the number of components in the handle and simplifies its assembly.

The handle advantageously includes a cooperation ramp via which the first lever operates the second lever.

The first lever may carry the cooperation ramp.

The handle is preferably such that rotation of the first lever over a first angle causes rotation of the second lever over a second angle greater than the first angle.

Accordingly, in this embodiment, the rotation movement of the first lever is amplified when it is transmitted to the second. It is therefore clear that the same amplitude of movement of the operating member drives a movement of greater amplitude of the cable operated by the second lever.

The handle is advantageously such that there exists at least one configuration of the handle in which a rotation axis of the second lever lies between a rotation axis of the first lever and the ramp.

This arrangement enables the amplification referred to above to be obtained.

The handle advantageously includes a manual operating member arranged to operate the first lever directly.

The handle may include an operating ramp via which the member operates the first lever.

The member preferably carries the operating ramp.

The handle preferably includes a sheath receiving the cable and having an upstream end rigidly fixed to the support.

The handle may also include a mechanism capable of inhibiting operation of the handle by the operating member if an acceleration of the handle has an intensity exceeding a predetermined threshold.

BRIEF DESCRIPTION OF DRAWINGS

Other features and advantages of the invention will become more apparent in the course of the following description of an embodiment given by way of nonlimiting example with reference to the appended drawings in which

FIGS. 1 and 2 show an automobile vehicle door handle 2. Only the parts of the handle relevant to the invention are shown. The other parts are of a conventional type and on this topic reference may be made to the document WO 2010/037622 for example.

DETAILED DESCRIPTION

Figure 1:
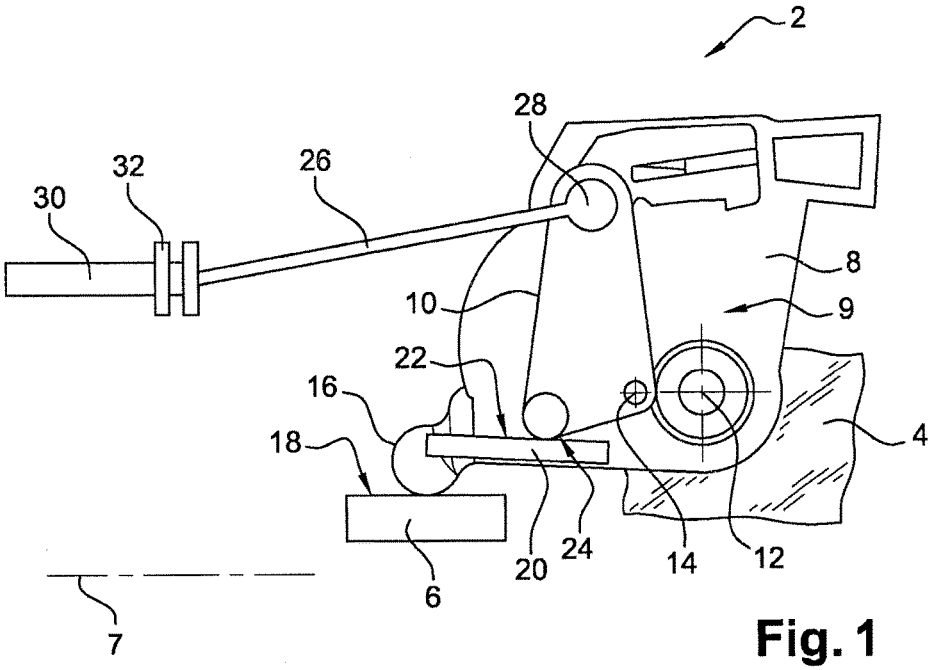
FIGS. 1 and 2 show two configurations of a handle in accordance with the invention, respectively at rest and during operation of the handle to open the door.

The door carrying the handle is for example a front or rear driver or passenger door or a rear hatch. In the present example the door is a front door giving access to the driver's seat.

The handle 2 includes a support or frame 4 rigidly fixed to a main panel of the door.

It includes a member 6 for operating the handle manually. Here this is a member accessible from outside the door and from outside the vehicle when the door is closed. This member is for example mounted to be mobile in rotation relative to the support 4 about a vertical axis 7.

The handle 2 includes a first lever 8 and a second lever 10 mounted to be mobile in rotation independently of each other about respective different axes 12, 14. The levers are therefore not coaxial. These axes are for example horizontal and parallel to the direction of forward movement of the vehicle, i.e. to the general plane of the door. The axes 12 and 14 of the two levers 8 and 10 are both carried directly by the frame 4 in this embodiment.

The levers 8 and 10 have a flat general shape and each lies in a plane perpendicular to the axes 12 and 14. The second lever faces one face 9 of the first lever 8.

The lever 8 has a free end 16 forming a follower coming into direct contact with a face 18 of the member 6 forming a ramp. Here this face is plane and therefore rectilinear in the section plane of the member shown in FIGS. 1 and 2. In the example described here, the section of the member 6 against which the follower 16 comes to bear moves when maneuvering the handle along a quasi-rectilinear trajectory similar to a movement in translation. Here this horizontal trajectory is perpendicular to the axes 7, 12 and 14. During this movement, the follower 16 remains in contact with the face 18 but moves along it as far as its edge nearest the axis 12. The follower 16 has a circular section cylindrical face for its contact with the actuating ramp 18, the axis of the cylinder being parallel to the axis 12.

The first lever 8 carries a raised pattern 20 projecting from the face 9 with reference to the direction of the axis 12. Here the raised pattern 20 takes the form of a bar and has a plane ramp face 22 against which an edge 24 of the second lever 10 comes to bear. The face 22 is parallel to the axes 12 and 14 but the latter are not contained within the plane of the face 22. The bar 20 is disposed so that, on operation of the handle, the rotation axis 14 passes between the face 22 and the rotation axis 12. In other words, there exists a configuration of the handle in which the axis 14 lies between the face 22 and the axis 12. The edge 24 has a circular section cylindrical face for its contact with the cooperation ramp 22, the axis of the cylinder being parallel to the axis 12.

The handle includes a cable 26 an upstream end 28 of which is attached to the second lever 10 at a distance from the axis 14. The downstream end of the cable, which is not shown, operates a mechanism for opening the door relative to the chassis of the vehicle. The handle includes a sheath 30 into which the cable 26 is threaded and in which it slides. At least at the level of its upstream end 32, the sheath 30 is rigidly fixed to the support 4.

Other mechanical connections for operating the lock may be envisaged, such as a rigid link, also driven directly or indirectly by the second lever.

The handle operates as follows.

Referring to FIG. 1, at rest, return springs that are not shown hold the operating member 6 in its position closest to the median longitudinal vertical plane of the vehicle, toward the bottom in FIG. 1, hold the first lever 8 with its edge 16 in contact with the ramp 18, and hold the edge 24 of the second lever 10 in contact with the ramp 22. The cable 26 is in its position most retracted inside the sheath 30.

Figure 2:
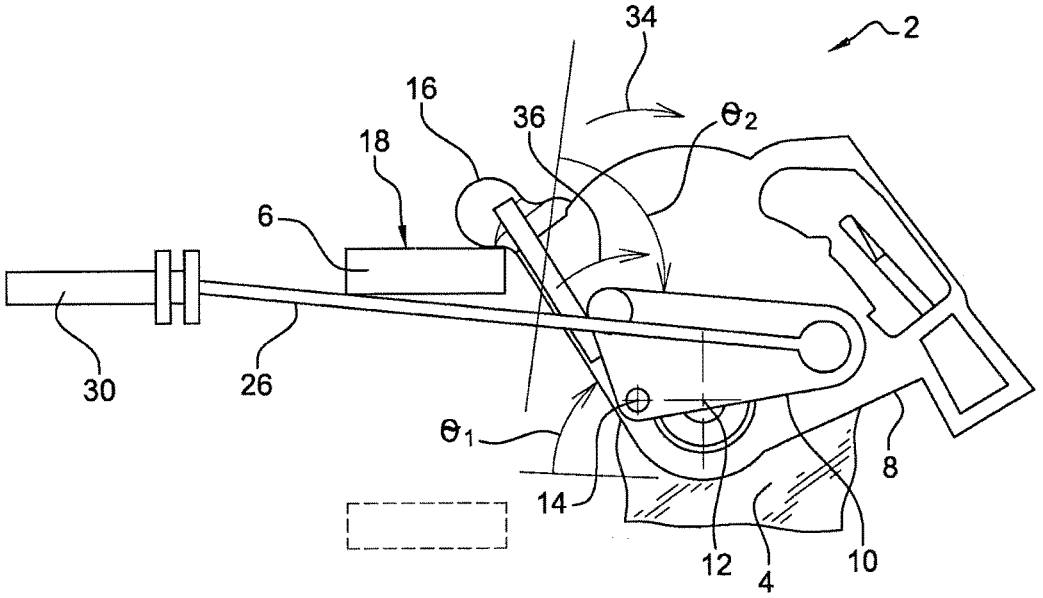

When a user actuates the manual operating member 6, see FIG. 2, this drives upward movement of the section carrying the ramp 18. During this movement, the edge 16 of the first lever 8 runs along the ramp, remaining in contact with it, which causes the first lever 8 to rotate in the clockwise direction indicated by the arrow 34 in FIG. 2.

Simultaneously, by contact with the edge 24, rotation of the cooperation ramp 20 drives rotation of the second lever 10, also in the clockwise direction as indicated by the arrow 36.

This rotation moves away from the sheath the end of the second lever that carries the cable and therefore results in traction on the latter. The movement of the cable relative to the sheath causes at their downstream end the actuation of the opening mechanism of the door.

It is therefore seen that the following parts drive each other directly in this order:

the manual maneuvering member 6,
the first lever 8,
the second lever 10, and
the cable 26.

Thanks to the aforementioned disposition of the axes 12 and 14 and the ramp 22, when the first lever 8 turns through an angle $\theta_1$ it causes movement of the second lever 10 through an angle $\theta_2$ larger than the angle $\theta_1$ and for example equal to 150% of the latter angle. The rotation movement of the first lever is therefore amplified or demultiplied on the second lever. Thus the amplitude of the movement of the cable 26 is increased without increasing the amplitude of the movement of the member 6. Nevertheless, the sheath 30 being fixed relative to the support 4, it does not generate any particular noise.

The handle in accordance with the invention thus makes it possible to reconcile simultaneously the requirement for a small amplitude of movement of the member 6 and that for a large amplitude of the movement of the cable 26.

The handle in accordance with the invention may include a lock or a dummy lock visible on the handle from outside the door.

It may also include an inertial mechanism capable of inhibiting operation of the handle by the member 6 if the handle is subjected to an acceleration, notably a lateral acceleration, having an intensity exceeding a predetermined threshold. This prevents the member 6 moving by inertia in the event of an impact of the vehicle against an exterior element, causing opening of the door.

Of course, numerous modifications can be made to the invention without departing from the scope of the invention.

What is claimed:

1. A vehicle door handle, comprising:

first and second levers mounted so that they rotate on a common support, the levers not being coaxial and being arranged so that the first lever operates the second lever via a cooperation ramp of the first lever, wherein the second lever operates a cable that includes an upstream end attached to the second lever at a distance from a rotation axis of the second lever and a downstream end configured to operate a mechanism for opening a door of a vehicle relative to a chassis of the vehicle; and a manual operating member accessible from outside of the door and outside of the vehicle when the door is closed, wherein the manual operating member includes an operating ramp that is arranged to directly operate the first lever, and arranged so that there exists at least one configuration of the handle in which the rotation axis of the second lever lies between a rotation axis of the first lever and the cooperation ramp at all times.

2. The handle as claimed in claim 1, arranged so that the first lever is in contact with the second lever.

3. The handle as claimed in claim 1, wherein the cooperation ramp is formed as part of the first lever.

4. The handle as claimed in claim 1, arranged so that rotation of the first lever over a first angle $\theta_1$ causes rotation of the second lever over a second angle $\theta_2$ greater than the first angle.

5. The handle as claimed in claim 1, wherein the operating ramp is formed as part of the manual operating member.

6. The handle as claimed in claim 1, further comprising a sheath receiving the cable.

* * * * *